US005875918A

United States Patent [19]

Sheffler et al.

[11] Patent Number: 5,875,918

[45] Date of Patent: Mar. 2, 1999

[54] HERMETICALLY-SEALED CONTAINER AND CLOSURE CONSTRUCTION

[75] Inventors: Robert J. Sheffler, Morganville; Charles Chang, Wayne, both of N.J.

[73] Assignee: Charles Chang, Wayne, N.J.

[21] Appl. No.: 800,997

[22] Filed: Feb. 20, 1997

[51] Int. Cl.[6] ..... B65D 41/16

[52] U.S. Cl. ..... 220/783; 220/4.21; 220/4.22; 220/4.23; 220/326; 220/335; 220/338; 220/339; 220/341; 220/783; 220/790; 220/791

[58] Field of Search ..... 220/4.21, 4.22, 220/4.23, 4.24, 4.25, 326, 335, 338, 339, 341, 780, 782, 783, 790, 791, 797, 805

[56] References Cited

U.S. PATENT DOCUMENTS

| | | | |
|---|---|---|---|
| 2,823,249 | 2/1958 | Curtiss | 220/783 X |
| 3,117,691 | 1/1964 | Williams | 220/783 |
| 4,671,423 | 6/1987 | Murphy | 220/354 |
| 4,708,259 | 11/1987 | Olimpio | 220/306 |
| 4,801,039 | 1/1989 | McCall et al. | 220/284 |
| 4,889,256 | 12/1989 | Fowles | 220/306 |
| 5,205,431 | 4/1993 | Zinnbauer | 220/326 |
| 5,425,469 | 6/1995 | Freedland | 220/404 |
| 5,529,205 | 6/1996 | Corney et al. | 220/342 |
| 5,531,349 | 7/1996 | Wojcik et al. | 220/339 |
| 5,722,554 | 3/1998 | Chanal et al. | 220/319 |

*Primary Examiner*—Stephen K. Cronin
*Attorney, Agent, or Firm*—H. Gibner Lehmann; K. Gibner Lehmann

[57] ABSTRACT

A container and sealing closure therefor, includes a container body part having an access opening and includes a continuous peripheral wall surrounding the access opening, and a closure part. The wall of the body part has a peripherally extending continuous sealing edge portion at its upper outer surface, the edge portion being coextensive with the wall. The closure part has a resilient skirt portion. The sealing edge portion of the wall of the container part has a sharp apex forming an included angle of substantially 90 degrees. The skirt portion of the closure part is adapted to mate in spaced relation, with the peripheral wall of the container part and has an inner surface which extends obliquely with respect to the peripheral wall of the body part and which is adapted to engage the apex. There are provided coengaging structural elements on the container body and closure parts, holding the resilient skirt portion of the closure part forcibly against the apex as the closure part is advanced against the container body part to a sealing, closed position thereon.

36 Claims, 9 Drawing Sheets

HERMETICALLY-SEALED CONTAINER AND CLOSURE CONSTRUCTION

NO CROSS REFERENCES TO RELATED APPLICATIONS

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates generally to containers for cosmetic substances and the like, and more particularly to articles of this type which are intended to provide an air-tight or hermetic seal between a container body and a lid or cover member therefor.

2. Description of the Related Art Including Information Disclosed under 37 CFR Sections 1.97–1.99

The following patents are cited as being of interest in the field to which the present invention pertains.

U.S. Pat. Nos.:

U.S. Pat. No. 3,117,691

U.S. Pat. No. 3,149,747

U.S. Pat. No. 5,139,165

Canadian Patent No. 2,047,926

British Patent No. 725,882

British Published Application No. GB 2 100 239A

Japanese Published Application No. 6-144453

European Published Application No. EP 478 848 A1

U.S. Pat. No. 3,117,691 relates to a container in the form of a vial constituted of HDPE, having on its lip an annular groove (18) with an undercut or shoulder (13). The vial is fitted with a closure cap having an external bead with an undercut shoulder (14), and with a conical lead-in surface (19) on the shoulder so as to facilitate assembly of the cap. Forcible by-pass of the bead and shoulder effects a seating of the edge of the cap into the groove. Sealing is purportedly effected by the engagement of a corner of the bead (14) with a conical surface of the shoulder, as noted in col. 2, line 48 of the patent specification.

U.S. Pat. No. 3,149,747 relates to a retainer construction for releasably joining plastic sheets, utilizing various types of tongue and groove formations, and wherein the respective tongue portions are provided with suitable enlargements or beads so as to enable a snap fit of the tongue portions into the respective groove portions. The use of different plastics is discussed, col. 3, beginning at line 15.

U.S. Pat. No. 5,139,165 involves a container for storage and shipping of photographic film. FIGS. 8(*a*) and 8(*b*) illustrate one embodiment wherein a lid (5) is provided with a downwardly facing peripheral groove having an undercut, and is receivable on the lip of a container. The lip in turn, has an enlargement or bead defining a cooperable undercut which can be received in the groove and brought into engagement with the surface of the undercut thereof. The resultant construction is alleged to have sealing characteristics, as noted in col. 3, line 54 of the patent specification.

Still other containers are shown in British Patent No. 725,882 and British Published Application No. GB 2 100 239A.

British Patent No. 725,882 discloses a jar having a lip with an external bead, and a lid having a peripheral groove with an undercut. Assembly of the lid to the jar results in seating of the bead against the undercut surface of the lid groove. British Application No. GB 2 100 239A discloses a container construction utilizing a safety interlock connection effected by cooperable beads on the lid and on the outer wall of a groove of the container lip, the interlock purportedly minimizing the likelihood of the lid being dislodged as a result of internal pressure in the container. Forcible by-pass of the interlocking beads is required during both application and removal of the lid.

Canadian Patent No. 2,047,926 discloses a container/closure construction wherein the lip of the container is provided with an outwardly-facing retainer bead, and the closure lid has a depending skirt with an inwardly facing bead that can by-pass the lip bead when the closure is assembled. An inner depending skirt on the closure is telescopically received in the bore of the neck, to provide a seal of the container interior.

Japanese Published Application No. 6-144453 discloses a method of blow molding a container and simultaneously affixing it to an existing molded closure cap. In accomplishing this, the lip of the container is formed in and occupies a peripheral groove in the closure cap. The latter has various layers of resin incorporated therein, believed to isolate the molded cap from potentially damaging heat transfer that would otherwise occur from the contact of the cap by the molten plastic of the container.

European Published Application No. EP 478 848 A1 relates to a container and closure, wherein the closure and container neck have cooperable bead-and-groove formations which effect a retention of the closure on the container.

One of the problems in the molded plastic container art is that the material must be sufficiently rigid so as to retain the shape and strength of the individual parts, whereby inadvertent distortion of either the container itself or the cap, is minimized. The material must be of sufficient rigidity to avoid being crushed when packaged, and during shipping and storage. At the same time, where it is desired to rely upon a plastic-to-plastic seal between a container lip and a closure cap, some degree of deformation is necessary as a consequence of less than ideal tolerances in the dimensions of the container and cap. Prior efforts to achieve effective seals have, to a large extent, resulted in compromises in the choice of materials, and the particular molded structures utilized for engagement with one another.

In container constructions characterized by relatively large areas of engagement between a lip portion and a closure cap portion, it is generally recognized that gaps tend to develop between the mating surfaces, in spite of the best efforts to avoid them. Stated differently, the absolute contact pressure from one point in a large surface to an adjoining point or to a remote point, is not uniform, in practice. Instead, "high" spots tend to press against each other, and "low" spots tend to become separated from one another. This characteristic is particularly in evidence when sealing a hinged cosmetic compact where cooperating surfaces of the cover and base are held together tightly only at the hinge and clasp; other points of contact are free to gap or bow. It is considered very difficult from a practical standpoint, to reduce this tendency for high and low spots to occur. This is especially true with molded plastic products because of any unpredictable shrinkage which occurs as the plastic cures.

Also, in attempting to provide a rigid container structure, the plastic which is used often lacks the necessary resilience, thereby sacrificing the integrity of any seal that is sought. A rubber gasket is a good example of a resilient article which has the required elastic and memory characteristics to deform and compress as required, when sandwiched between two otherwise rigid components such as a glass jar and a metal lid. Rubber, however, is generally unsuitable as far as possible utilization in the fabrication of containers (compacts, jars) and closures of the type with which the present invention is concerned.

SUMMARY

The above drawbacks and disadvantages of prior containers and closures are largely obviated by the present invention which has for one object the provision of a novel and improved hermetically sealable container and closure which are both simple in their structure and reliable and effective in use.

Another object of the invention is to provide an improved, hermetically sealable container and closure as above set forth, which can be readily fabricated in simple plastic molds, and at low cost.

Yet another object of the invention is to provide an improved, hermetically sealable container and closure in accordance with the foregoing, which is characterized by a unique line-of-contact type engagement between the sealing portion of a container and a closure, thereby providing peripheral pressures of a type necessary in order to insure the establishment of a continuous and uninterrupted air-tight or hermetic seal, while still utilizing plastic substances which have the required strength and rigidity characteristics to render them useable for a wide variety of cosmetic products, including cosmetic compacts, lipsticks, and/or cases of various kinds utilized in color cosmetics, hair care formulations, health and beauty aids.

Still another object of the invention is to provide improved hermetically sealable packaging components as above characterized, which are highly resistant to inadvertent breakage, as from rough handling during storage or shipping, or during use by the consumer.

Yet another object of the invention is to provide improved hermetically sealable cosmetic components of the kinds indicated, which eliminate the need for special sealing gaskets or rings, thereby reducing the overall number of parts required and also eliminating unnecessary additional assembly operations.

The above objects are accomplished by a container and sealing closure therefor comprising in combination, a container body part having an access opening and a continuous peripheral wall surrounding the access opening, and wherein the wall has a peripherally extending continuous sealing edge portion which is coextensive with the remainder of the wall, and comprising a closure part having a resilient skirt portion. The sealing edge portion of the peripheral wall comprises a sharp apex forming an included angle of substantially 90 degrees. The skirt portion of the closure is adapted to mate in spaced relation with the peripheral wall of the container part, and the skirt portion has an inner surface which extends obliquely with respect to the peripheral wall of the body part and which is adapted to engage the apex. There are provided coengaging means on the container and closure parts, holding the resilient skirt portion of the closure part forcibly against the apex as the closure part is advanced against the container body part, to close the same.

The arrangement is such that a highly effective seal is accomplished owing to the limited area of contact between the edge portion of the wall of the body part and the oblique surface of the skirt of the closure part, in a preferred embodiment.

BRIEF DESCRIPTION OF THE DRAWINGS

In the drawings, illustrating various embodiments of the invention.

DESCRIPTION OF THE PREFERRED EMBODIMENTS

Figure 1:
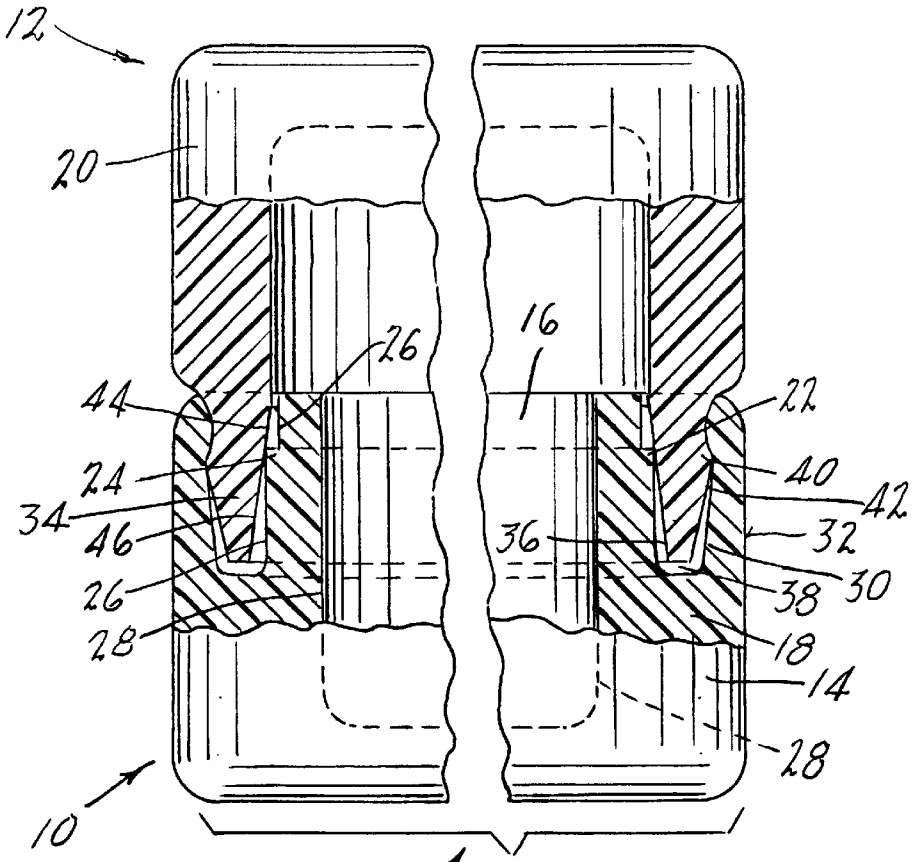
FIG. 1 is a side view, partly in elevation and partly in axial section, of a container construction and closure therefor, fabricated in accordance with the principles of the present invention.

Referring first to FIG. 1 there is illustrated an improved container and sealing closure therefor, the container being designated generally by the numeral 10, and the closure being indicated at 12. The container comprises a body part 14 having a mouth or access opening 16 which is surrounded by a continuous peripheral wall 18. The closure comprises a closure part 20.

In accordance with the present invention there is provided on the container body part 14 and closure or closure cap part 20, a novel sealing mechanism which relies essentially on a relatively high, linear or line-like pressure track or area that is established by a sharp, substantially 90 degree apex or corner configuration on one of either the closure part 20 or container body part 14, and a cooperable tapered surface on the other of either the closure part 20 or container body part 14, and wherein the engagement is maintained by coengaging means on the container body part and closure part, which operate to force the sharp apex into sealing engagement with the tapered surface whenever the closure part is being seated on the container body part.

In accomplishing the improved seal, the peripheral wall 18 of the container body part 14 has a continuous sealing edge portion comprising an apex 22 that is disposed at the junction of a ledge 24 and a broader side surface 26 of the peripheral wall 18, such ledge 24 and side surface 26 defining an included angle of substantially 90 degrees. Other side surfaces of the wall 18 are designated 28, 30 and 32, respectively.

Referring again to FIG. 1, in accomplishing the seal, the closure part 20 is provided with a depending resilient skirt portion 34 that has a tapered inner surface 36 which extends obliquely with respect to the surface 26 of the peripheral wall 18 of the container body part 14 and is adapted to engage the sealing edge or apex 22 thereof. The arrangement is such that the ledge 24 and surface 26 which form the included angle at the apex 22 are both oblique to the inner surface 36 of the skirt portion 34, with the apex 22 bearing against the surface 36 at a single line-like path or track thereon when the closure part 20 is seated as in FIG. 1.

The coengaging means that forces the skirt portion 34 against the apex 22 can, in a preferred embodiment, comprise the surface 30 of the peripheral wall 18 on the container body part 14. In effect, the surfaces 26 and 30 define an annular groove or well 38 that receives the depending skirt portion 34 of the closure part 20.

In FIG. 1, the skirt portion 34 preferably has an external bead 40, and the surface 30 has an undercut 42. During application of the closure part 20 to the body part 14, the bead 40 is forced into the groove 38 and seats in the undercut 42. FIG. 1 shows the groove, and diagrammatically illustrates the resilient engagement of the bead 40 with the wall of the undercut 42. Where either the bead 40 or the surface of the undercut 42 is resilient, momentary yielding of one or both parts occurs, and the resiliency biases the skirt portion 34 radially inwardly after seating, forcing the tapered surface 36 into biting engagement with the sharp edge or apex 22.

In practice and as can be seen in FIG. 1, the spacing between the portion 44 of the surface 36 which lies above the apex 22 and the adjacent surface 26 is non-uniform, being greater immediately adjacent the apex 22, and less as the distance from the apex increases, measured axially of the container body part 14.

Also, preferably the spacing between the portion 46 of the surface 36 which lies below the apex 22 and the adjacent surface 26 is non-uniform, being smaller immediately adjacent the apex 22, and greater as the distance from the apex increases, measured axially of the container body part. The surfaces 44 and 46 are shown as being non-cylindrical.

The above construction has the following important advantages. Due to the absence of broad sealing surfaces, as is characteristic of many of the devices of the prior art, by the present invention the contact between the closure part 20 and container body part 14 occurs essentially along a linear track at the apex 22. Since pressure is calculated to be force per unit area, where a line contact exists the area is a small number, and the resultant contact pressure which exists is relatively high. As presently understood, the high pressure which is established between the engaging surfaces is a significant factor in the attainment of an effective air-tight seal, in accordance with the present invention. Such cooperation is free from even slight undulations and aberrations normally present among planar surfaces.

In contrast, many sealing arrangements of the prior art which involve broad surfaces that engage one another, do not enjoy high contact pressures similar to that described in connection with the present invention. In the case of large surface areas which are in contact with one another, the total force existing between two sealing members is spread over a correspondingly large area. Accordingly, such large areas of engagement give rise to low-pressure contacts, measured in terms of pressure units, such as $g/m^2$, and so forth. The present invention is seen to largely overcome the undesirable effects of a poor seal arising from the engagement of large surface areas on the components making up the seal.

A further feature of the present invention resides in the fact that with the disclosed structure, reliance is placed on essentially radially extending forces between the closure part 20 and container body part 14, as opposed to axial pressures as was the case with many of the prior art constructions. For example, in the prior art, where a continuous thread cap is utilized to apply an axially downward pressure on a gasket carried thereby and against the lip of the container body part, slight misalignments or warping tend to give rise to poor seals. In addition, certain resilient gaskets take a set and experience "creep" after a period of compression, and thus lose some of their resiliency.

In contrast, by the present invention, no utilization of gaskets per se is made, and the forces which exist between the apex 22 and the skirt portion surface 36 are almost exclusively radial in direction. Such an arrangement is considered to facilitate installation and removal of the closure part 20 from the container body part 14.

Figure 2:
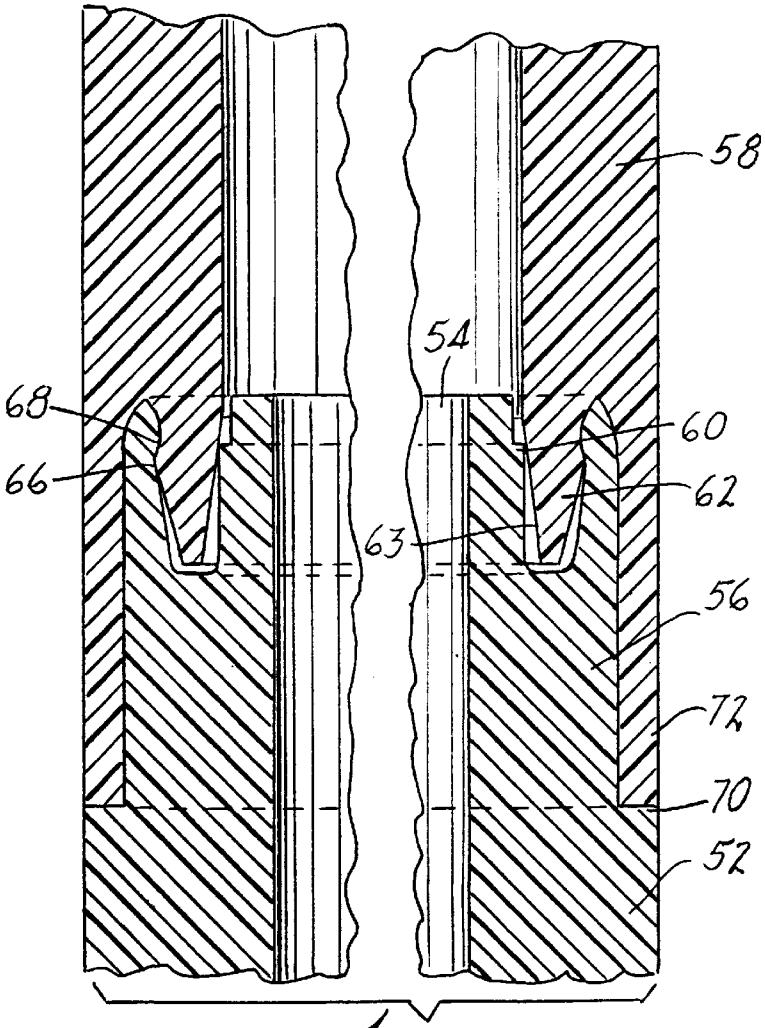
FIG. 2 is a view like FIG. 1, of a somewhat modified container and closure, constituting another embodiment of the invention.

Another embodiment of the invention is shown in FIG. 2, illustrating a modified container and closure construction. The container comprises a body part 52 having a mouth 54 and a continuous peripheral wall 56. The closure part is indicated at 58.

By the invention, the peripheral wall 56 of the container body part 52 has a sealing edge portion comprising an apex 60 that is disposed at the junction of a ledge and a broader side surface of the peripheral wall, similar in construction to the arrangement of FIG. 1.

The closure part 58 has a depending resilient skirt portion 62 that has a tapered inner surface 63 which is adapted to engage the sealing edge or apex 60. The arrangement is such that there is formed an included angle of 90 degrees at the apex 60, and the latter tends to bite into the surface 63 at a single linear path or track thereon when the closure part 58 is seated as in FIG. 2.

Coengaging means forcing the skirt portion 62 against the apex 60 can comprise an undercut 66 on the surface of the peripheral wall 56 of the container body part 52, and a bead 68 on the skirt portion 62. During installation, the bead 68 seats in the undercut 66.

Further, by the invention, in FIG. 2 the container body part 52 is provided with an external, upwardly facing ledge 70, and the closure part comprises an outer depending skirt 72, adapted to be received on the ledge 70, and to butt against the upwardly facing surface thereof. With such a construction, an improved wedging action occurs between the bead 68 of the skirt portion 62 and the surface of the undercut 66, since the latter is in effect, captive in a downwardly facing trough of the closure part 58, and additional plastic material surrounds and thus backs up the surface of the trough. Less yielding of the wall of the container body part 52 will occur, and consequently the retentive force on the closure part 58 can be increased by utilization of the structure shown in this figure.

In addition, from the aesthetic standpoint, the construction of FIG. 2 is advantageous in that it conceals the joint between the skirt portion 62 and wall 56, which would otherwise be visible as in the construction of FIG. 1. In other respects the embodiment of FIG. 2 is similar to that of FIG. 1.

The present invention has particular application in the field of cosmetics, and is especially adaptable for incorporation in lipstick cases or cosmetic compacts.

Figure 4:
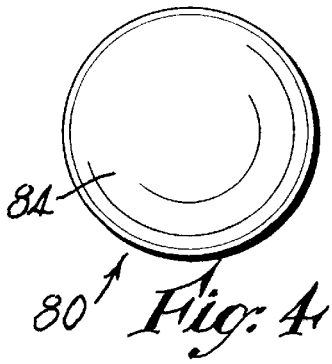
FIG. 4 is a top plan view of the lipstick case of FIG. 3.
Figure 3:
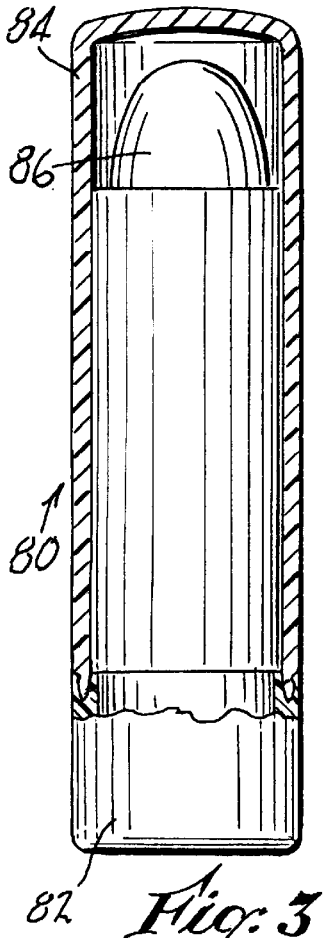
FIG. 3 is a front view, partly in elevation and partly in axial section, of a cylindrical lipstick case constructed in accordance with the principles of the present invention and as shown in FIG. 1.
Figure 5:
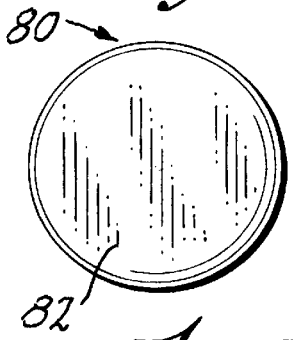
FIG. 5 is a bottom plan view of the lipstick case of FIGS. 3 and 4.

Specific cosmetic applications of the novel containers and sealing closures of the present invention are illustrated respectively in FIGS. 3–5; 6–8; and 9–11.

FIGS. 3–5 illustrate a lipstick case 80, comprising a base 82 and cover 84, and molded stick product 86 carried in the base 82. By the present invention, the base 82 and cover 84 are provided with the novel sealing mechanism described in connection with the embodiment of FIG. 1. In particular, the sealing mechanism between the lipstick base 82 and cover 84 relies essentially on the relatively high, linear or line-like pressure track that exists between the 90 degree corner configuration on the base at the apex 22 in FIG. 1, and the cooperable tapered inner surface 36 in FIG. 1. The engagement is maintained by coengaging means on the base and cover, corresponding to parts 40 and 42 of FIG. 1, which operate to force the apex 22 into sealing engagement with the tapered surface 36 whenever the cover is assembled to the base.

The lipstick case of FIGS. 3–5 has a substantially round cross sectional configuration, as illustrated in FIGS. 4 and 5.

Figure 7:
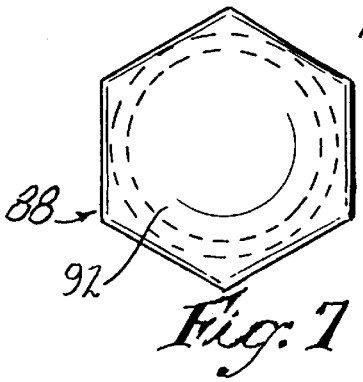
FIG. 7 is a top plan view of the lipstick case of FIG. 6.
Figure 6:
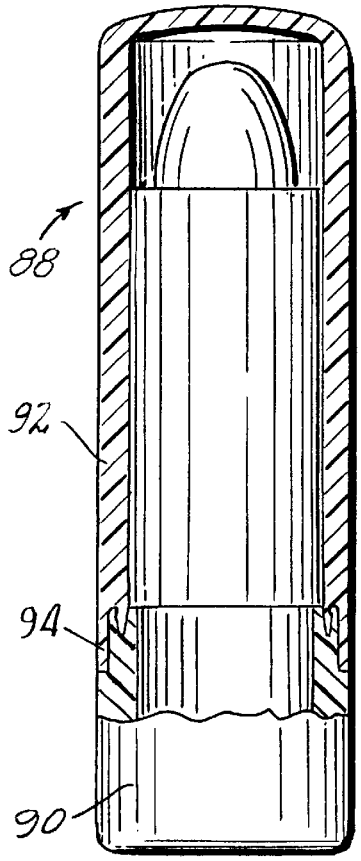
FIG. 6 is a view like FIG. 3, of a modified lipstick case utilizing the construction of FIG. 2, wherein the cross sectional configuration is a polygon, constituting still another embodiment of the invention.
Figure 8:
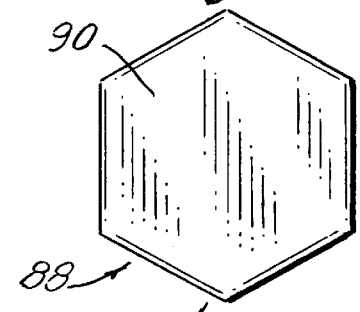
FIG. 8 is a bottom plan view of the lipstick case of FIGS. 6 and 7.

FIGS. 6–8 illustrate the sealing mechanism of the invention as applied to a lipstick case of hexagonal cross sectional configuration, comprising a base 90 and a cover 92, and wherein the cover 92 is provided with an external, peripheral depending skirt portion 94 which surrounds the area of the seal, and provides a smooth interface between the base 90 and cover 92. A sealing construction corresponding to that of FIG. 2 is utilized in the device of FIGS. 6–8.

Figure 10:
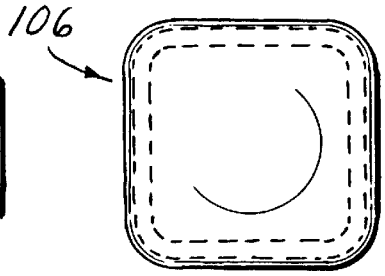
FIG. 10 is a top plan view of the lipstick case of FIG. 9.
Figure 9:
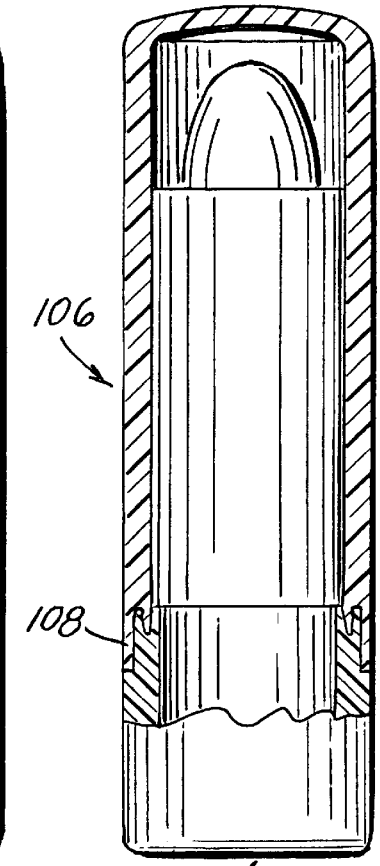
FIG. 9 is a view like FIG. 3, of a further modified lipstick case wherein the cross sectional configuration is generally square, with rounded corners, constituting yet another embodiment of the invention.
Figure 11:
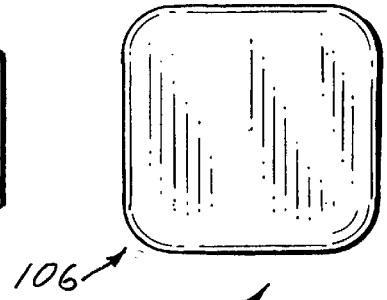
FIG. 11 is a bottom plan view of the lipstick case of FIGS. 9 and 10.

Similarly, FIGS. 9–11 show still another embodiment, wherein the sealing mechanism of the invention is applied to a lipstick case 106 of generally square cross sectional configuration, with the corners of the square being rounded mainly for aesthetic reasons. A peripheral skirt 108 is provided, as in FIG. 2, to present a smooth transition between the base and cover.

Figure 12:
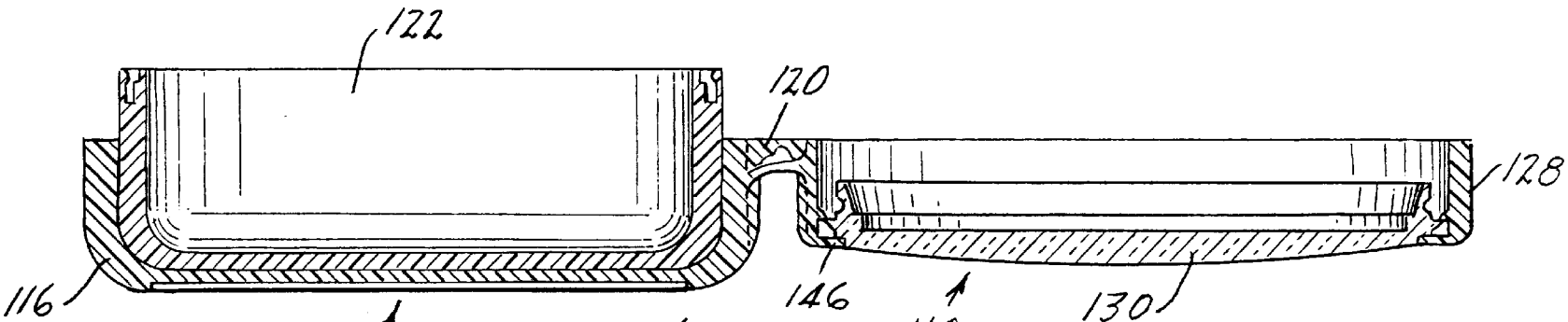
FIG. 12 is an axial section, enlarged, of a cosmetic compact constructed in accordance with the principles of the present invention, shown in an open position, constituting yet another embodiment of the invention.
Figure 14:
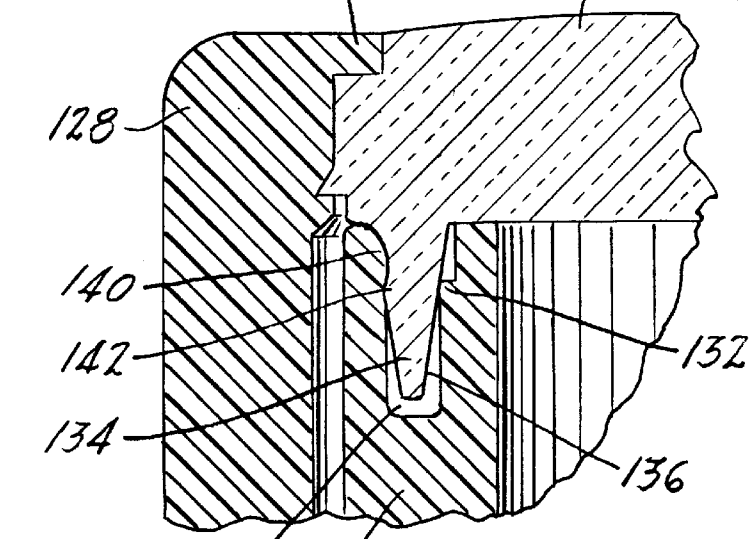
FIG. 14 is a fragmentary axial section, greatly enlarged, of a portion of the container rim and lid of the cosmetic compact of FIGS. 12 and 13.
Figure 13:
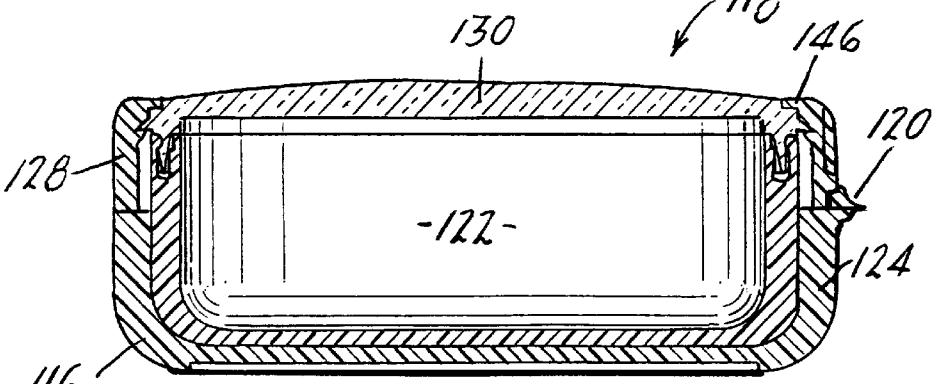
FIG. 13 is an axial section of the cosmetic compact of FIG. 12, showing the cosmetic compact in a closed, sealing position.
Figure 15:
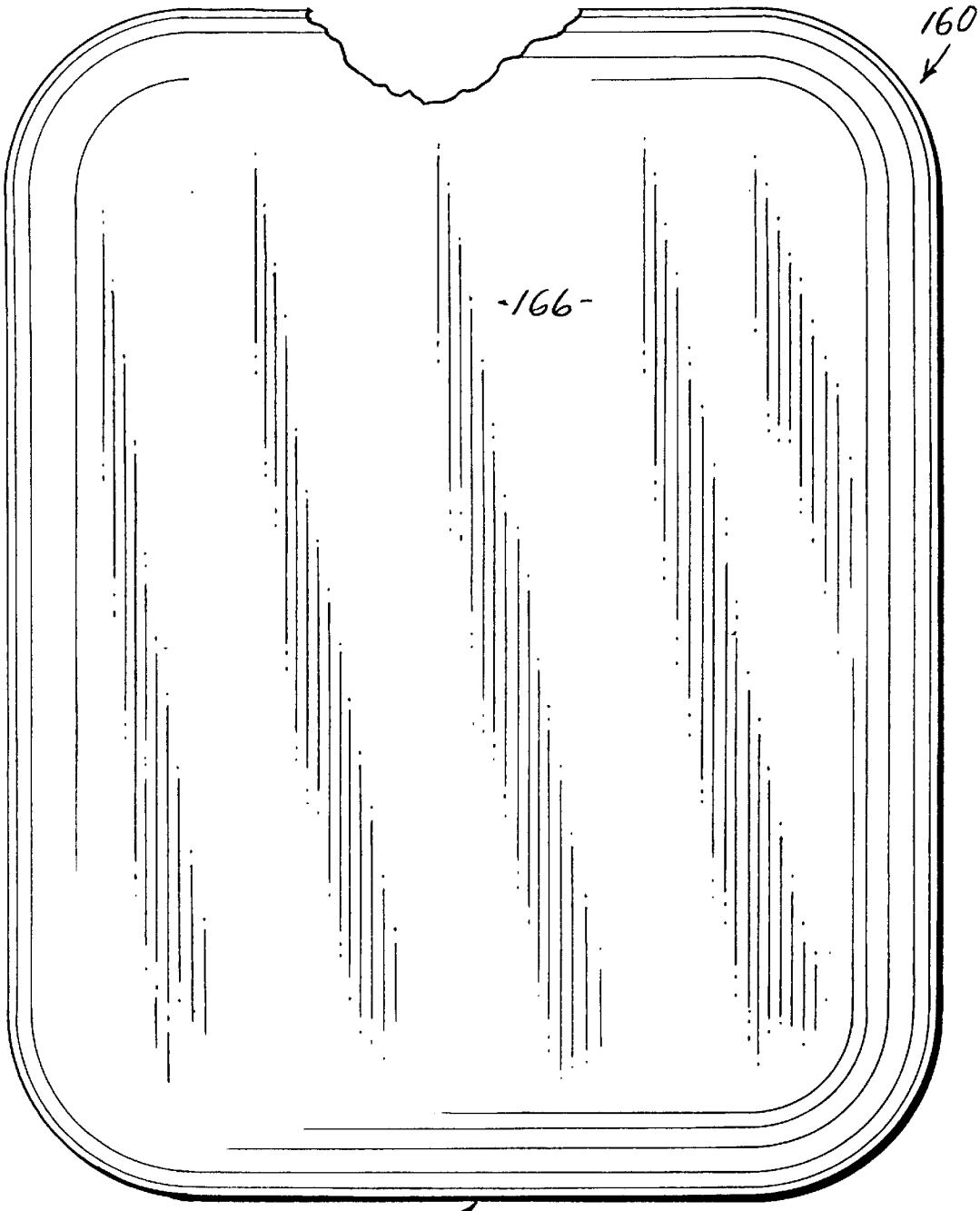
FIG. 15 is a top plan view of a further modified cosmetic compact, constituting still another embodiment of the invention.
Figure 16:
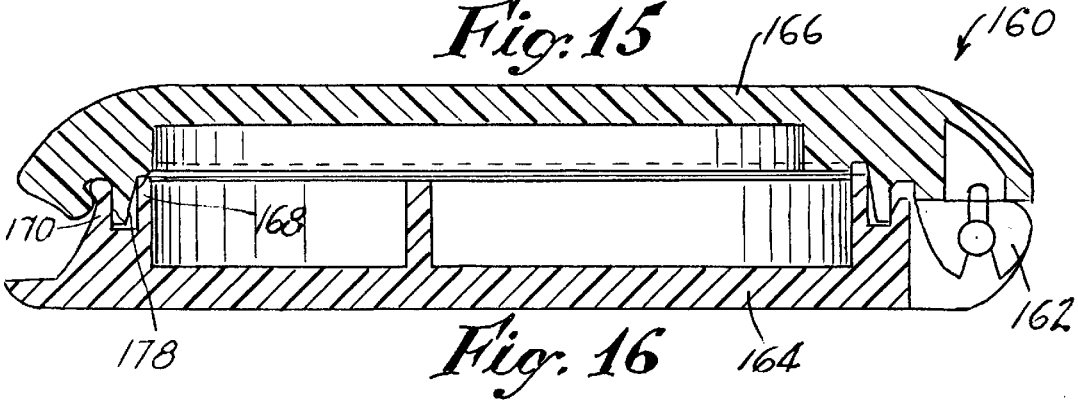
FIG. 16 is a transverse axial section of the compact of FIG. 15.
Figure 17:
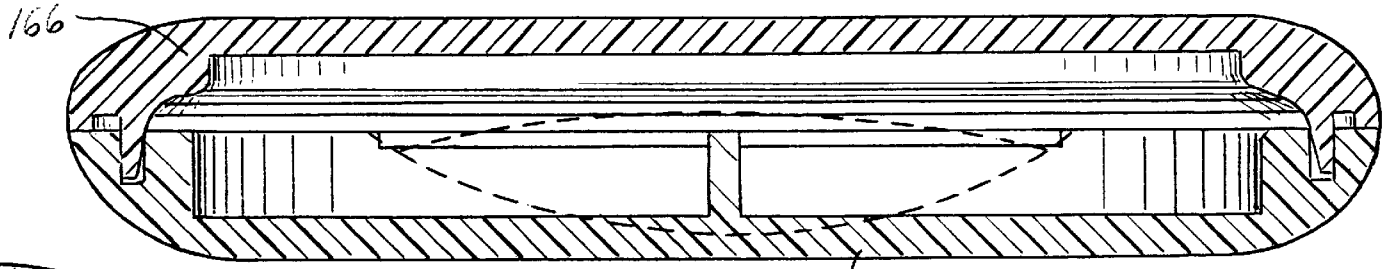
FIG. 17 is a transverse axial section of the compact of FIGS. 15 and 16, taken at 90 degrees with respect to the section of FIG. 16, and showing in dotted outline, a recess constituting a finger-engageable lifting edge construction for opening the compact.

A further embodiment of the invention is shown in FIGS. 12–14, illustrating a cosmetic compact generally designated by the numeral 114. The compact 114 comprises a base member or container body part 116, and a hinged closure part 118 which may be integrally molded with the base member 116. A dead-center, snap-action hinge 120 may be incorporated in the compact, the details of which are, per se, known in the art.

In the present instance, the container body part 116 comprises a cup 122 which telescopically fits into a shell portion 124 of the base 116, the cup 122 having an upwardly facing groove 126 that is similar in construction to groove 38 of FIG. 1, as to its contour. The closure part 118 comprises a peripheral ring member 128 and as a separate insert, a lens member 130, which may be transparent or semi-transparent. By the present invention, the wall of the cup 122 has a continuous sealing edge or apex 132 that forms a sharp corner similar to that indicated 22 in FIG. 1. The lens member 130 is provided with a depending resilient skirt portion 134 that has a tapered inner surface 136 which is adapted to engage the sealing edge or apex 132. The arrangement is such that the faces which form the apex 132 are both oblique to the inner surface 136 of the skirt portion 134, with the apex bearing against this surface at a single linear path or track thereon when the closure part 118 is seated.

As in the previous embodiments, coengaging means force the skirt portion 134 against the apex 132, the coengaging means comprising an undercut surface 140 on the cup 122, and a bead 142 on the skirt portion 134. The bead 142 is received in the undercut surface 140 in order to effect the desired retention.

In practice, the lens member 130 is held in place by a peripheral flange 146 on the ring member 132, and a tongue and groove formation on the lens member 130 per se and the inner wall of the ring member 128, as in FIG. 14. Optionally, a finger-engageable lifting edge (not shown) is provided, to facilitate opening of the compact.

Still another embodiment of the invention is shown in FIGS. 15–18, illustrating the sealing mechanism of the invention as applied to a modified cosmetic compact 160 having a conventional hinge 162. The compact is characterized by a body part or base 164 and a closure part 166, with the base 164 having a peripheral wall portion 168 with a continuous sealing edge or apex 169. A second wall portion 170 surrounds the first, forming an upwardly facing groove 172. By the invention the sealing edge or apex 169 is formed by divergent surfaces disposed at an included angle on the order of 90 degrees. The closure part 166 has a resilient skirt portion 176 which is received in the groove 172 in the base 164, and the skirt portion 176 has an inner surface 178 which extends obliquely with respect to the peripheral wall portion 168 of the base and is adapted to engage the sealing edge or apex 169. In the present instance, the sharp corner or apex 169 is disposed at the lip of the base, particularly the innermost edge thereof.

In effecting the seal, the tapered surface 178 of the skirt portion 176 is engaged by the sharp, 90 degree apex 169, with the latter in effect, bearing against the tapered surface 178 along a series of joined line segments which follow the generally rectangular contour of the compact 160. As in the previous embodiments, there is achieved a high-pressure contact as a consequence of the limited area of engagement between the apex or edge 169 and the tapered surface 178. In practice, the skirt portion 176 wedges into the groove 172 and is frictionally held therein. Internal bead 182 on the closure part 166 along with an external bead 184 on the base, can optionally be provided, to retain the closure part in its closed, sealing position. A finger-engageable lifting edge 186 is also provided, opposite the hinge 162, so as to facilitate opening of the compact.

Figure 18:
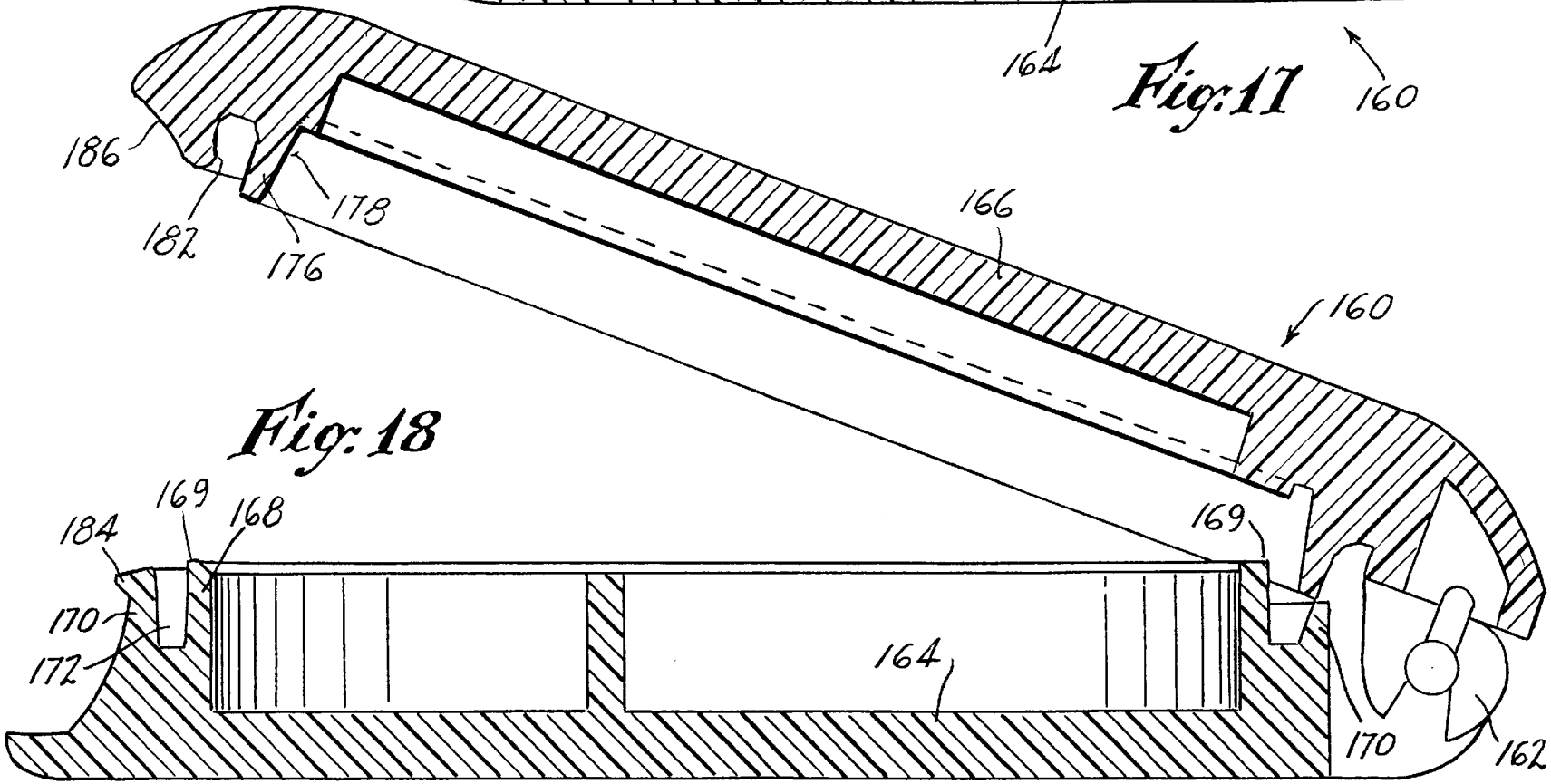
FIG. 18 is a view similar to FIG. 16, enlarged, showing the compact partially opened, and revealing a finger-engageable lifting edge construction.

FIG. 18 shows a cross section of the compact in a partially open condition, wherein the tapered sealing surface 178 has left the groove 172 of the base 164, and the compact is about to be opened for accessing the applicator (not shown) and cosmetic material (not shown) carried in the compartments of the base.

Figure 19:
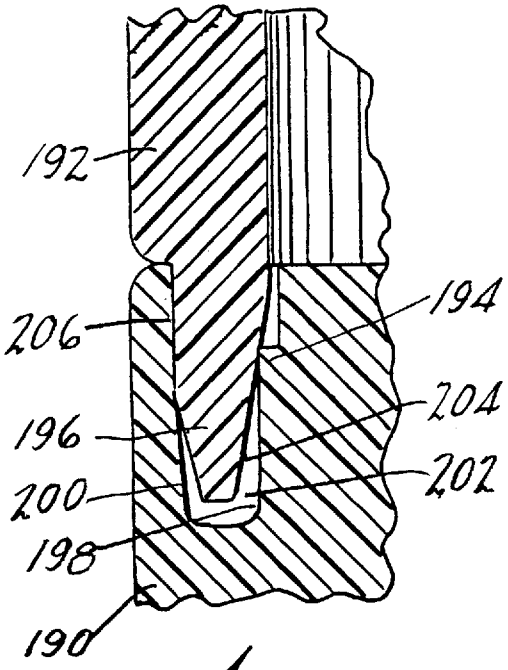
FIG. 19 is a view like FIG. 1, of a further modified container construction and closure therefor, constituting another embodiment of the invention.

Another embodiment of the invention is illustrated in FIG. 19, showing a container body part 190 and closure part 192, and which utilizes a sealing structure comprising an apex designated 194 on the body part, and a depending skirt portion 196 on the closure part 192. The body part has a peripheral wall with facing concentric surfaces 198 and 200, defining a groove 202. The skirt portion 196 has a tapered inner surface 204, adapted to be forcibly engaged by the apex 194 when the closure part 192 is seated on the container body part 190. In contrast to the embodiment of FIG. 1, the embodiment of FIG. 19 omits the bead and undercut arrangement corresponding to the numerals 40 and 42 of FIG. 1, and instead relies on a frictional engagement between the surfaces 200 and 206, and in addition, the resilience of the container body part 190, which squeezes or wedges the skirt portion 196, and forces the tapered inner surface 204 thereof into engagement with the apex 194.

Figure 20:
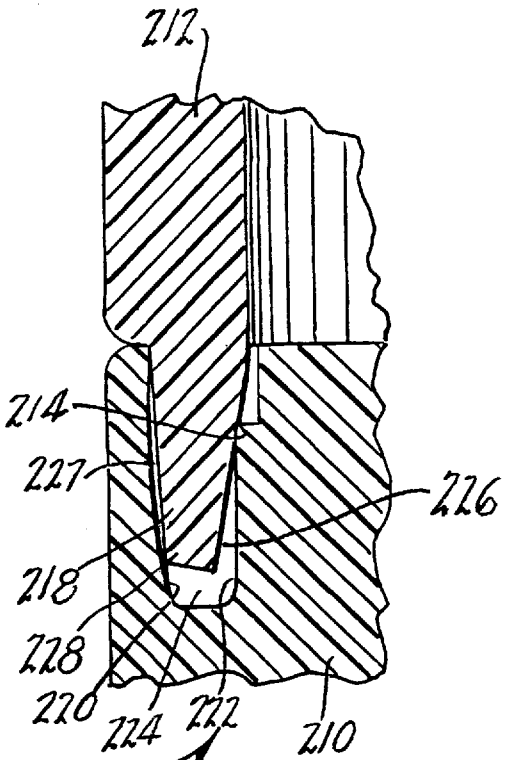
FIG. 20 is a view like FIG. 19, of a still further modified container and closure, constituting still another embodiment of the invention.

FIG. 20 illustrates yet another embodiment, showing a container body part 210 and closure part 212, and which utilizes a sealing structure comprising an apex designated 214 on the peripheral wall of the body part 210, and a depending skirt portion 218 on the closure part 212. The container body part 210 has facing concentric surfaces 220 and 222 of a groove 224. By the invention, the skirt portion 218 has a tapered inner surface 226, which is forcibly engaged by the apex 214 when the closure part 212 is seated on the container body part 210. Also, by the invention, in FIG. 20 the surface 227 is bowed or otherwise curved in cross-section, and the lower edge of the skirt portion 218 is provided with a supplemental sealing edge 228, for intimate engagement with the surface 220 of the groove 224. With such an arrangement, a secondary seal is established between the edge 228 and surface 220, this latter seal being disposed deep in the groove 224.

Figure 21:
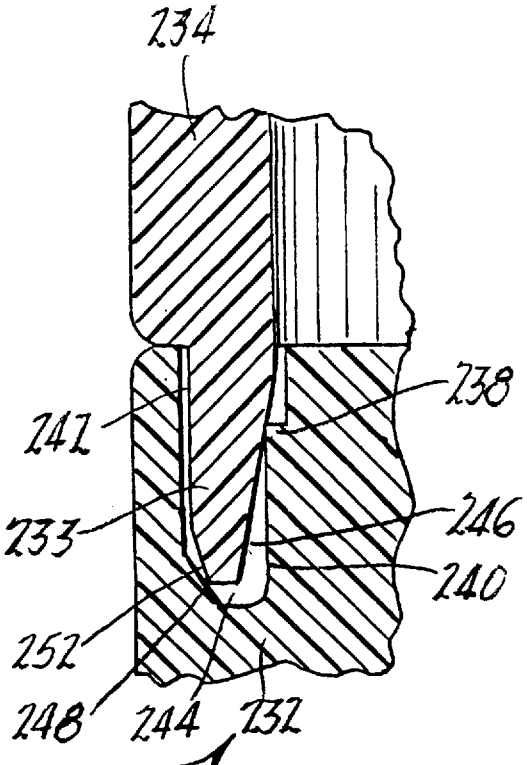
FIG. 21 is a view like FIG. 19, of yet a further modified container and closure, constituting yet another embodiment of the invention.

In FIG. 21 there is shown a further embodiment in which there are provided a container body part 232 and closure part 234, and a sealing structure comprising an apex on the body part 232, and a depending skirt portion 233 on the closure part 234. The body part 232 has a peripheral wall containing the apex 238, with adjoining concentric surfaces 240 and 242, defining a groove 244. As in the previous embodiment, the skirt portion 233 has a tapered inner surface 246, adapted to be forcefully engaged by the apex 238 when the closure part 234 is seated on the container body part 232. By the invention, there is provided an annular surface 248 at the bottom of the groove 244, and the skirt portion 233 terminates in a taper or bevel portion having a sharp edge 252, which latter forms a supplementary seal with the surface 248 when the closure part 234 is seated on the container body part 232.

Figure 22:
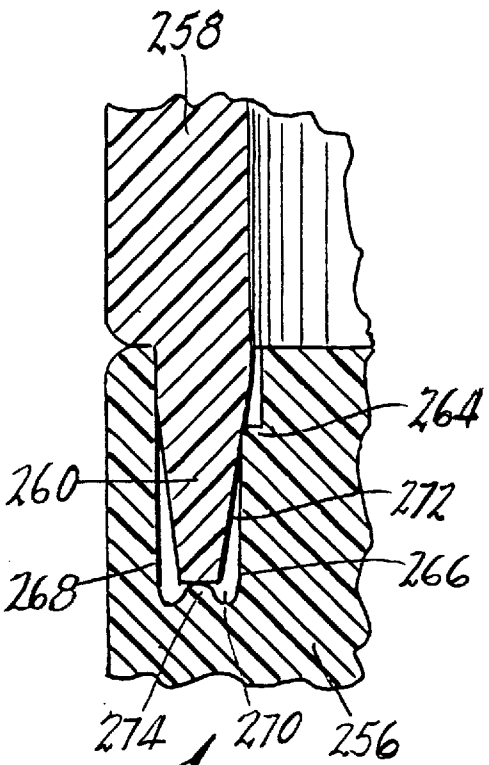
FIG. 22 is a view like FIG. 19, of still a further modified container and closure, constituting yet another embodiment of the invention.

Still other embodiments are illustrated in FIGS. 22–25, respectively. In FIG. 22, there is illustrated a container body part 256 and closure part 258, and a sealing structure comprising an apex on the body part, and a depending skirt portion 260 on the closure part 258. The body part 256 has a peripheral wall containing the apex 264, with adjoining concentric surfaces 266 and 268 of a groove 270. The skirt portion 260 has a tapered inner surface 272, adapted to be forcefully engaged by the apex 264 when the closure part 258 is seated on the container body part 256. By the present invention, the bottom of the groove 270 is provided with an upstanding annular bead 274, which engages the lip of the skirt portion 260 and establishes a secondary seal. This may be of significant importance particularly in the case where the plastic material of either the container body part 256 or the closure part 258 is resilient. The primary seal is established by the engagement of the tapered surface 272 with the apex 264 of the wall of the container body part 256 as in the previous embodiments.

Figure 23:
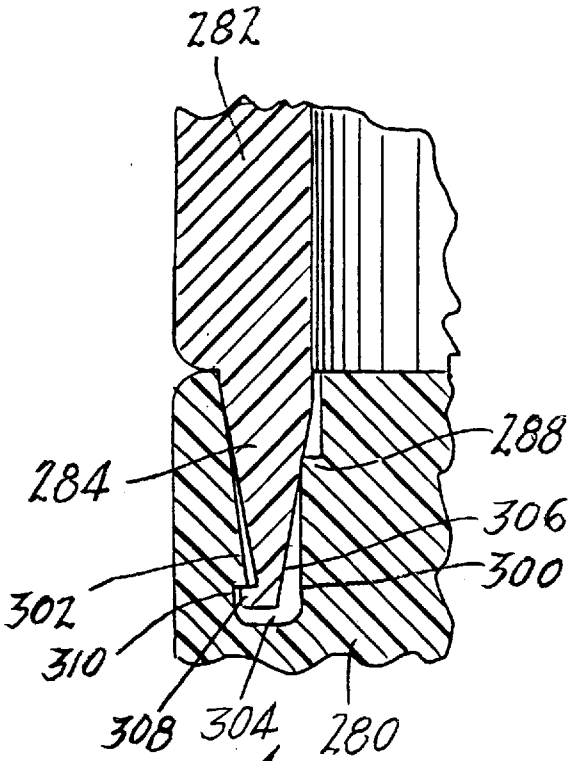
FIG. 23 is a view like FIG. 19, of a still further modified container and closure, constituting another embodiment of the invention.

FIG. 23 shows a further modification, involving a container body part 280 and closure part 282, and a sealing structure comprising an apex on the body part 280, and a depending skirt portion 284 on the closure part 282. The body part 280 has a peripheral wall which contains the apex 288, with adjoining concentric surfaces 300 and 302 of a groove 304. The skirt portion 284 has a tapered inner surface 306, adapted to be forcefully engaged by the apex 288 when the closure part 282 is seated on the container body part 280. By the invention there is provided an external retention bead 308 at the bottom edge of the skirt portion 284, which is receivable in an undercut 310 of the groove 304 of the container body part 280. The bead 308 and undercut 310 thus form a snap-lock, which normally retains the closure part 282 in assembled relation on the container body part 280, but the bead can forcibly by-pass the undercut during removal of the closure part 282. In this connection, the degree of overlap of the bead 308 and wall of the undercut 310 is such as to provide adequate retention during storage or shipping of the product, while enabling the closure part 282 to be readily removed upon the user applying a reasonable force thereto.

Figure 24:
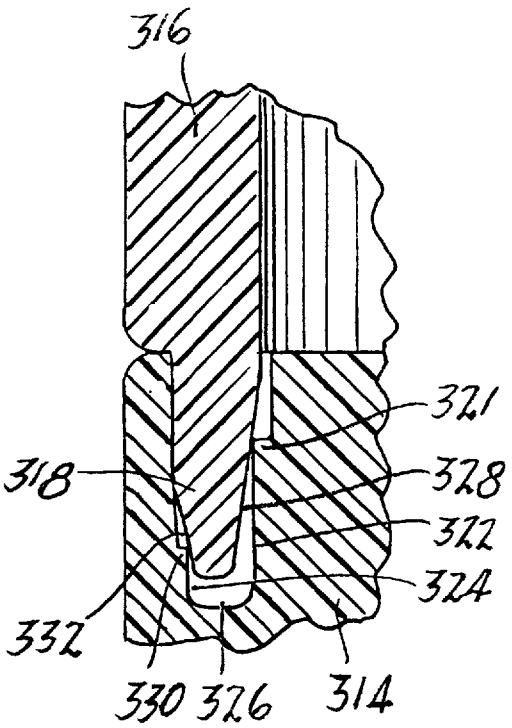
FIG. 24 is a view like FIG. 19, of yet a further modified container and closure, constituting still another embodiment of the invention.

FIG. 24 illustrates still another embodiment of the invention. As in the immediately preceding embodiment, there are provided a container body part 314 and closure part 316, and a sealing structure comprising an apex on the body part 314, and a depending skirt portion 318 on the closure part 316. The body part 314 has a peripheral wall containing the apex 321, with adjoining concentric surfaces 322 and 324 of a groove 326. The skirt portion 318 has a tapered inner surface 328, adapted to be forcefully engaged by the apex 321 as the closure part 316 is seated on the container body part 314. In the present embodiment, the one surface 324 of the groove 326 is provided with an annular ledge 330, and the outer surface of the skirt portion is tapered, at 332. A secondary seal similar to that of the primary seal is thus realized, with the resilience of the skirt portion 318 and the surfaces 328, 332 maintaining a wedging relationship that effects a simultaneous forceful engagement between the apex 321 and surface 328, and the corner of the ledge 330 and surface 332.

Figure 25:
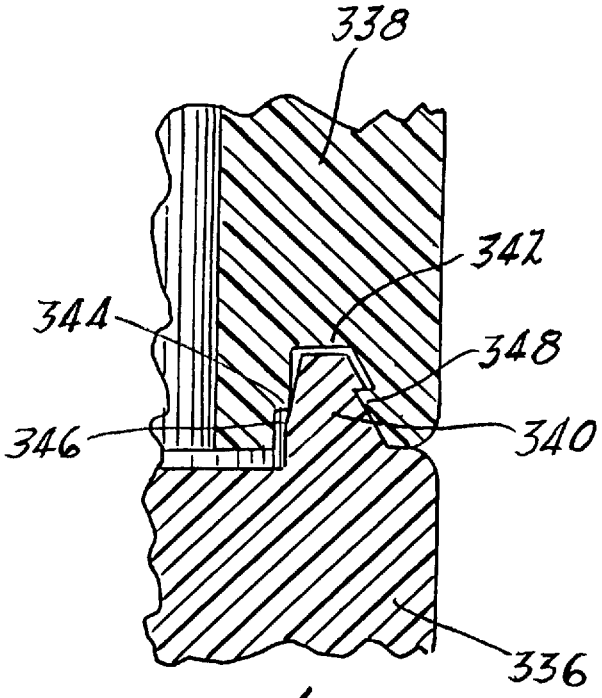
FIG. 25 is a view like FIG. 19, of a still further modified container and closure, constituting yet another embodiment of the invention.

FIG. 25 illustrates still another embodiment of the invention, comprising a container body part 336 and closure part 338, the container body part 336 being provided with an upstanding skirt portion 340, and the closure part having a downwardly facing groove 342. By the invention, the seal is established between an apex 344 in this figure, and a tapered surface 346 of the upstanding skirt portion 340. The latter has an undercut 348 which cooperates with a similar undercut in the groove 342, to maintain the closure part 338 in a normally closed condition. The retention characteristics are similar to those of the construction of FIG. 23. With the arrangement of FIG. 25, a shortened skirt portion 340 is featured, with the accompanying advantage of a more aesthetic appearance. This is important from the marketing standpoint, as in the case of a cosmetic product where the skirt portion might be so disposed as to encircle a mirror or a powder compartment, for example. Also, with the downwardly facing groove 342 being provided in closure part 338 as opposed to being on the container body part 336, there is had the further advantage that any tendency for cosmetic product to collect in the groove is eliminated, because the groove faces downwardly, as opposed to the prior constructions wherein an upwardly facing groove was utilized.

From the above it can be seen that we have provided novel and improved containers for cosmetic products, especially adapted for use with lipsticks, compacts, or other consumer-oriented cosmetic articles. The seal provided is as presently understood, more reliable than was the case in the container art as previously known or proposed. For the most part, little reliance is placed on axial forces between a cover and container, in effecting the seal. Instead, lateral forces between the side wall of a container and a corresponding skirt portion of a cover are utilized, in a novel wedging action that results in a forceful engagement between a sharp corner configuration on one component, and a tapered sealing surface on the other, which latter undergoes slight deformation to an extent depending on the relative resiliency of the materials used, and also upon the relative hardness of the materials. Depending on the resiliency of the mating surfaces, one surface can be thought of as biting against the other.

In preferred embodiments, components of equal hardness and resiliency can be utilized. Alternately, within the scope of the invention, either the apex or the tapered surface can have a greater hardness than that of the other, in order to meet the requirements of a particular application, and depending on the nature of the closing action involved, i.e. a hinged connection vs. a straight-application of a cover to a container, as in the case of a lipstick.

The disclosed constructions are thus seen to represent a distinct advance and improvement in the field of cosmetic dispensers.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A container and sealing closure therefor comprising, in combination:

a) a container body part having an access opening and a continuous peripheral wall surrounding said access opening, said wall having a peripherally extending continuous sealing edge portion which is coextensive with the remainder of the wall, b) said sealing edge portion comprising a sharp apex, c) a closure part having a wedge sealing means comprising a resilient skirt portion with an inner surface adapted to mate in spaced relation with the peripheral wall of the container part, said inner surface extending obliquely with respect to the peripheral wall of the body part and being adapted to engage with a wedging action the apex of the said sealing edge portion, and d) coengaging means on said container and closure parts, holding said resilient skirt portion of the closure part forcibly against said apex as the oblique inner surface of the closure part is advanced against the apex of the sealing portion of the container body part to close the same and slidably wedge the skirt portion of the closure part against the said apex of the sealing edge portion.

2. A container and sealing closure therefor as set forth in claim 1, wherein the said sealing edge portion of the peripheral wall comprises an outwardly facing side surface thereof.

3. A container and sealing closure therefor as set forth in claim 1, wherein the coengaging means comprises a sloped face of the resilient skirt portion, and a cooperable side surface of the said continuous peripheral wall of the container body part.

4. A container and sealing closure therefor as set forth in claim 1, wherein the sealing edge portion of the wall comprises a ledge thereon.

5. A container and sealing closure therefor as set forth in claim 1, wherein:

a) the coengaging means comprises a portion of the peripheral wall of the container body part, spaced outwardly from another portion of the peripheral wall thereof, b) said resilient skirt portion occupying the space between the said peripheral wall portions.

6. A container and sealing closure therefor as set forth in claim 1, wherein the coengaging means includes a tapered portion of said resilient skirt portion.

7. A container and sealing closure therefor as set forth in claim 1, wherein the container body part and the closure part comprise a lipstick case.

8. A container and sealing closure therefor as set forth in claim 1, wherein the continuous peripheral wall of the body part has a pair of concentric side surfaces.

9. A container and sealing closure therefor as set forth in claim 8, wherein the said sealing edge portion of the peripheral wall comprises one of said side surfaces of the wall.

10. A container and sealing closure therefor as set forth in claim 1, wherein the peripheral wall of the container body part comprises a top rim part, and said sealing edge portion comprises said top rim part.

11. A container and sealing closure therefor as set forth in claim 10, wherein:

a) the continuous peripheral wall of the body part has a pair of concentric side surfaces, b) the said sealing edge portion of the wall is on one side surface thereof.

12. A molded plastic container for cosmetics, and a molded plastic, press-fit sealing closure therefor, comprising in combination:

a) a container body part having a storage space that opens to an access opening which is commensurate in size with the span of said space, said body part having a continuous thin peripheral wall surrounding said access opening and said wall having a peripherally extending continuous sealing edge portion located on one surface thereof, said sealing edge portion being integral and coextensive with said wall, b) said sealing edge portion comprising a sharp apex, c) a closure part having a wedge sealing means in the form of a resilient skirt portion comprising an inner surface adapted to mate in spaced relation with one surface of the continuous peripheral wall of the container body part, said inner surface at most points being spaced from and oblique with respect to the thin peripheral wall of the body part and being adapted at other points to engage with a wedging action and with a continuous line contact, the apex of the said sealing edge portion, and d) coengaging wedging detent means on said container and closure parts, said wedging and detent means holding said resilient skirt portion of the closure part forcibly against the said apex of the sealing edge portion of the container body part as the closure part is advanced against the apex of the sealing portion of the container body part with a press fit, to close the body part and slidably wedge the skirt portion of the closure part against the said apex of the sealing edge portion, e) said coengaging wedging detent means being opposed by the forcible engagement of the resilient skirt portion with the said apex of the sealing edge portion, f) said coengaging wedging detent means having cooperable continuous friction surfaces which are forced past each other during the said engagement of the apex, g) one of said friction surfaces being resilient and deformable.

13. A container and sealing closure therefor as set forth in claim 12, wherein the spacing between the surface of the resilient skirt portion which lies above the apex and the adjacent surface of the peripheral wall is non-uniform, being greater immediately adjacent the apex, and less as the distance from the apex increases, measured axially of the container.

14. A container and sealing closure therefor as set forth in claim 12, wherein the spacing between the surface of the resilient skirt portion which lies below the apex and the adjacent surface of the peripheral wall is non-uniform, being smaller immediately adjacent the apex, and greater as the distance from the apex increases, measured axially of the container.

15. A sealable container construction and closure therefor, comprising in combination:

a) a container body part and a closure cap part, b) one of said parts having a peripheral groove with oppositely facing resilient wall portions, c) one of said wall portions comprising a projecting bead forming an undercut configuration, d) the other of said wall portions comprising a stepped shoulder presenting substantially a 90 degree, sharp corner configuration, e) the other of said parts comprising a resilient skirt portion having at one side, a projecting bead forming an undercut configuration, said projecting bead of the said one wall portion being receivable in the undercut configuration of the skirt portion of the other of said parts, so as to engage the undercut configuration and thereby retain the parts in assembled relation by means of a snap fit, f) said skirt portion having at its other side, a frusto-conical surface, said frusto-conical surface having an upper portion and a lower portion, g) said stepped shoulder being urged into forcible, intimate engagement with the frusto-conical surface of said skirt portion by the resilient engagement of the projecting bead of said one wall portion and the undercut configuration, said intimate engagement occurring at substantially continuous linear contact located midway between the upper portion and the lower portion of said frusto-conical surface, so as to form a concentrated line of sealing contact at said stepped shoulder and said frusto-conical surface.

16. A sealable container construction and closure therefor as set forth in claim 15, wherein:

a) the engagement of said stepped shoulder with said frusto-conical surface causes deformation of the latter and penetration into the surface thereof.

17. A sealable container construction and closure therefor as set forth in claim 15, wherein:

a) said peripheral groove has a bottom wall portion, and the skirt portion extends into the groove only to an extent wherein the lower edge of the skirt portion is spaced above the bottom wall portion such that the groove can accommodate either greater or lesser degrees of advancement of the skirt portion therein.

18. A sealable container construction and closure therefor as set forth in claim 15, wherein:

a) said closure part has said peripheral groove, which faces in a downward direction when the container and closure are held in an upright position, and b) said container body part having said resilient skirt portion which is received in said groove when the closure is assembled to the container.

19. A sealable container construction and closure therefor as set forth in claim 18, wherein:

a) said groove has an undercut configuration in one of its wall portions, and b) the edge of the skirt portion has an annular bead which releasably engages the surface of the undercut configuration of the groove when the closure is assembled to the container.

20. A container and sealing closure therefor comprising, in combination:

a) a container body part having an access opening and a continuous peripheral wall surrounding said body part, said wall having a peripherally extending continuous sealing ledge which projects from its surface and which is coextensive with the wall, b) said sealing ledge having a sharp apex portion which separates it into divergently-facing surfaces, c) a cover part having a resilient skirt portion provided with a conical inner surface adapted to wedge and mate with the peripheral wall of the container part and engage the said sealing ledge thereof, and d) coengaging means on said container and cover parts, forcing said sealing ledge partially into said resilient skirt portion of the cover part as the latter is advanced against the container part to close the same and slidably wedge the skirt portion of the closure part against the said apex portion of the sealing ledge.

21. A sealable container construction and closure therefor, comprising in combination:

a) a container body part and a closure cap part, b) one of said parts having a peripheral groove with oppositely facing resilient wall portions, c) one of said wall portions comprising a stepped shoulder presenting substantially a sharp, 90 degree apex, d) the other of said parts comprising a resilient skirt portion having an inner surface of substantially frusto-conical configuration, e) said sharp, 90 degree apex being urged into forcible engagement with the frusto-conical surface of said skirt portion by the resilient engagement of the skirt portion with the other of the oppositely facing resilient groove wall portions, said forcible engagement occurring at substantially continuous linear contact located midway between the upper portion and the lower portion of said frusto-conical surface, so as to form an air-tight seal between said apex and said frusto-conical surface.

22. A sealable container construction and closure therefor as set forth in claim 21, wherein:

a) the other of said wall portions of said groove has a peripheral relieved area whereby it engages the skirt portion at axially spaced lines of contact when the closure cap part is assembled to the container body part.

23. A sealable container construction and closure therefor as set forth in claim 21, wherein:

a) said groove has a bevel adjacent to its bottom wall, and b) the lower edge of the skirt portion has at its outermost surface, a taper terminating in a sharp edge which resiliently engages the bevel in the groove.

24. A sealable container construction and closure therefor as set forth in claim 21, wherein:

a) said groove has a raised track in its bottom wall, and b) the lower edge of the skirt portion resiliently engages the raised track of the bottom wall of the groove when the closure is assembled to said container.

25. A sealable container construction and closure therefor as set forth in claim 21, wherein:

a) said groove has an undercut configuration adjacent its bottom wall, and b) the lower edge of the skirt portion has an annular bead which releasably engages the wall of the undercut configuration of the groove.

26. A sealable container construction and closure therefor as set forth in claim 21, wherein:

a) said groove has a second apex adjacent its bottom wall, and b) the lowermost edge of the skirt portion has a frusto-conical surface which sealingly engages the apex of the groove when the closure is assembled to said container.

27. A container and sealing closure construction comprising, in combination:

a) a container body part having an access opening and a continuous peripheral wall surrounding said access opening, said wall having a peripherally extending continuous edge sealing portion which is coextensive with the remainder of the wall, b) a closure part having wedge sealing means comprising a peripherally extending sealing portion adapted to mate in spaced relation with said peripherally extending edge sealing portion of the container part, said peripherally extending sealing portion being disposed obliquely with respect to the said edge sealing portion, c) said edge sealing portion comprising a sharp apex forming an acute included angle, d) said peripherally extending sealing portion being adapted to engage said apex of said edge sealing portion, and e) coengaging means on said container and closure parts forcing said sealing portions of the said two parts forcibly toward each other to bring said apex into sealing engagement with said peripherally extending sealing portion as the closure part is forced on the container body part to close the same.

28. A container and sealing closure therefor as set forth in claim 27, wherein said sharp apex is resilient.

29. A container and sealing closure therefor as set forth in claim 27, wherein said one sealing portion is resilient.

30. A container and sealing closure therefor comprising, in combination:

a) a container body part having an access opening and a continuous peripheral wall surrounding said access opening, said wall having a peripherally extending continuous sealing edge portion which is coextensive with the remainder of the wall, b) said sealing edge portion comprising a sharp apex forming an included angle of substantially 90 degrees, c) a closure part having a resilient skirt portion with an inner surface adapted to mate in spaced relation with the peripheral wall of the container part, said inner surface extending obliquely with respect to the peripheral wall of the body part and being adapted to engage the apex of the said sealing edge portion, and d) coengaging means on said container and closure parts, holding said resilient skirt portion of the closure part forcibly against said apex as the closure part is advanced against the container body part to close the same, e) said coengaging means comprising a portion of the peripheral wall of the container body part, spaced outwardly from another portion of the peripheral wall thereof, f) said resilient skirt portion occupying the space between the said peripheral wall portions, g) said closure part having an outer depending skirt, surrounding and spaced from the said resilient skirt portion thereof.

31. A container and sealing closure therefor comprising, in combination:

a) a container body part having an access opening and a continuous peripheral wall surrounding said access opening, said wall having a peripherally extending continuous sealing edge portion which is coextensive with the remainder of the wall, b) said sealing edge portion comprising a sharp apex forming an included angle of substantially 90 degrees, c) a closure part having a resilient skirt portion with an inner surface adapted to mate in spaced relation with the peripheral wall of the container part, said inner surface extending obliquely with respect to the peripheral wall of the body part and being adapted to engage the apex of the said sealing edge portion, d) coengaging means on said container and closure parts, holding said resilient skirt portion of the closure part forcibly against said apex as the closure part is advanced against the container body part to close the same, e) said container body part and said closure part being hingedly connected together and comprising a cosmetic compact.

32. A container and sealing closure therefor comprising, in combination:

a) a container body part having an access opening and a continuous peripheral wall surrounding said access opening, said wall having a peripherally extending continuous sealing edge portion which is coextensive with the remainder of the wall, b) said sealing edge portion comprising a sharp apex forming an included angle of substantially 90 degrees, c) a closure part having a resilient skirt portion with an inner surface adapted to mate in spaced relation with the peripheral wall of the container part, said inner surface extending obliquely with respect to the peripheral wall of the body part and being adapted to engage the apex of the said sealing edge portion, d) coengaging means on said container and closure parts, holding said resilient skirt portion of the closure part forcibly against said apex as the closure part is advanced against the container body part to close the same, e) said container body part comprising a cosmetic compact base portion and a product-receiving cup telescopically received therein, f) said closure part comprising a cosmetic compact cover, g) said product-receiving cup having said sharp apex, and said closure part having said resilient skirt portion.

33. A container and sealing closure therefor comprising, in combination:

a) a container body part having an access opening and a continuous peripheral wall surrounding said access opening, said wall having a peripherally extending continuous sealing edge portion which is coextensive with the remainder of the wall, b) said sealing edge portion comprising a sharp apex forming an included angle of substantially 90 degrees, c) a closure part having a resilient skirt portion with an inner surface adapted to mate in spaced relation with the peripheral wall of the container part, said inner surface extending obliquely with respect to the peripheral wall of the body part and being adapted to engage the apex of the said sealing edge portion, d) coengaging means on said container and closure parts, holding said resilient skirt portion of the closure part forcibly against said apex as the closure part is advanced against the container body part to close the same, e) said container body part comprising a cosmetic compact base portion, f) said closure part comprising a cosmetic compact cover having a peripheral annular component and a central viewing lens component secured thereto, g) said resilient skirt portion being disposed on solely said lens component.

34. A container and sealing closure therefor as set forth in claim 33, wherein:

a) said lens component is telescopically fitted into said peripheral annular component, and wherein all portions of said peripheral component are disposed radially outside of said resilient skirt portion.

35. A container and sealing closure therefor comprising, in combination:

a) a container body part having an access opening and a continuous peripheral wall surrounding said access opening, said wall having a peripherally extending continuous sealing edge portion which is coextensive with the remainder of the wall, b) said sealing edge portion comprising a sharp apex forming an included angle of substantially 90 degrees, c) a closure part having a resilient skirt portion with an inner surface adapted to mate in spaced relation with the peripheral wall of the container part, said inner surface extending obliquely with respect to the peripheral wall of the body part and being adapted to engage the apex of the said sealing edge portion, d) coengaging means on said container and closure parts, holding said resilient skirt portion of the closure part forcibly against said apex as the closure part is advanced against the container body part to close the same, e) said container body part comprising a cosmetic compact base portion, and f) said closure part comprising a cosmetic compact cover, g) said base portion and cover utilizing a hinge, and said base portion and cover being molded integrally with one another.

36. A container and sealing closure therefor comprising, in combination:

a) a container body part having an access opening and a continuous peripheral wall surrounding said access opening, said wall having a peripherally extending continuous sealing edge portion which is coextensive with the remainder of the wall, b) said sealing edge portion comprising a sharp apex forming an included angle of substantially 90 degrees, c) a closure part having a resilient skirt portion with an inner surface adapted to mate in spaced relation with the peripheral wall of the container part, said inner surface extending obliquely with respect to the peripheral wall of the body part and being adapted to engage the apex of the said sealing edge portion, d) coengaging means on said container and closure parts, holding said resilient skirt portion of the closure part forcibly against said apex as the closure part is advanced against the container body part to close the same, e) said container body part comprising a cosmetic compact base portion, and f) said closure part comprising a cosmetic compact cover, g) said base portion and cover being connected by a mechanical hinge, for enabling pivotal movement with respect to one another.

* * * * *